US010202671B2

(12) United States Patent
Xing et al.

(10) Patent No.: US 10,202,671 B2
(45) Date of Patent: Feb. 12, 2019

(54) HIGH PROOF STRESS AL—ZN ALUMINUM ALLOY EXTRUSION MATERIAL SUPERIOR IN BENDABILITY

(71) Applicants: NIPPON LIGHT METAL COMPANY, LTD., Tokyo (JP); HONDA MOTOR CO., LTD., Tokyo (JP)

(72) Inventors: Jie Xing, Shizuoka (JP); Masato Yatsukura, Tokyo (JP); Shinichiro Sumi, Shizuoka (JP); Peizheng Lin, Shizuoka (JP); Shoji Mochizuki, Shizuoka (JP); Naoki Takaki, Wako (JP); Nao Sugimoto, Saitama (JP)

(73) Assignees: NIPPON LIGHT METAL COMPANY, LTD., Tokyo (JP); HONDA MOTOR CO., LTD., Tokyo (JP)

( * ) Notice: Subject to any disclaimer, the term of this patent is extended or adjusted under 35 U.S.C. 154(b) by 495 days.

(21) Appl. No.: 14/707,599

(22) Filed: May 8, 2015

(65) Prior Publication Data

US 2015/0329949 A1 Nov. 19, 2015

(30) Foreign Application Priority Data

May 13, 2014 (JP) ..... 2014-099970

(51) Int. Cl.
*C22C 21/10* (2006.01)
*C22F 1/053* (2006.01)

(52) U.S. Cl.
CPC ..... *C22C 21/10* (2013.01); *C22F 1/053* (2013.01)

(58) Field of Classification Search
CPC ..... C22F 1/053; C22C 21/10
See application file for complete search history.

(56) References Cited

U.S. PATENT DOCUMENTS

| | | | | |
|---|---|---|---|---|
| 3,322,533 | A * | 5/1967 | Martin | C22C 21/10 148/698 |
| 8,105,449 | B2 | 1/2012 | Yoshida et al. | |
| 9,206,496 | B2 | 12/2015 | Shikama et al. | |
| 2007/0074791 | A1 | 4/2007 | Yoshida et al. | |
| 2013/0213533 | A1 | 8/2013 | Shikama et al. | |

FOREIGN PATENT DOCUMENTS

| | | | |
|---|---|---|---|
| JP | 1994-212338 | A | 8/1994 |
| JP | 1996-120388 | A | 5/1996 |
| JP | 1998-298691 | A | 11/1998 |
| JP | 2007-119904 | A | 5/2007 |
| JP | 2013-189706 | A | 9/2013 |

OTHER PUBLICATIONS

Notification of Reasons for Refusal issued in Japanese Patent Application No. 2014-099970, dated May 9, 2017.

* cited by examiner

*Primary Examiner* — Jessee R Roe
(74) *Attorney, Agent, or Firm* — Knobbe Martens Olson & Bear LLP

(57) ABSTRACT

A high proof stress aluminum alloy extrusion material having superior bendability and crack resistance. The high proof stress aluminum alloy extrusion material is an aluminum alloy comprising: 5.0 to 7.0 wt % of zinc; 0.5 to 1.5 wt % of magnesium; 0.05 to 0.3 wt % of copper; no greater than 0.15 wt % of zirconium; 0.1 to 0.4 wt % of iron; 0.05 to 0.4 wt % of silicon; with the balance being Al and impurities, in which at least 90% of a metallographic structure is a recrystallized structure.

8 Claims, 4 Drawing Sheets

HIGH PROOF STRESS AL—ZN ALUMINUM ALLOY EXTRUSION MATERIAL SUPERIOR IN BENDABILITY

This application claims priority to Japanese Patent Application No. 2014-099970, filed May 13, 2014, the content of which is incorporated herein by reference.

BACKGROUND OF THE INVENTION

Field of the Invention

The present invention relates to a high proof stress 7000 series (Al—Zn—Mg) aluminum alloy extrusion material which is superior in bendability. The aluminum alloy extrusion material is suitable for complex shapes such as products shaped into shapes with a hollow part or a semi-hollow part with a high tongue ratio, and used for machine parts such as automobiles and two wheel vehicles.

Related Art

Generally, the structure of the aluminum alloy extrusion material includes a fiber-like crystalline form composed of subgrains and a crystalline form composed of recrystallized grains, and a recrystallized structure tends to be formed in a surface part which is especially highly processed and tends to accumulate strain due to characteristics of an extrusion process. The 7000 series aluminum alloy is highest in mechanical strength among all aluminum alloys, and an extrusion material thereof is a constructional material used in a part requiring mechanical strength and manufactured with an aging treatment for obtaining mechanical properties with high proof stress. In order to maintain high mechanical strength of the extrusion material, a major part of a metallographic structure is composed of a fiber-like structure, which requires suppression of recrystallization in manufacture. Therefore, a method of adding elements suppressing recrystallization (Zr, Mn, Cr, etc.), a method of extruding at a low temperature, a method of quickly chilling after extrusion, and the like have been conventionally used for suppressing formation of the recrystallized structure (Japanese Unexamined Patent Application Publication Nos. H10-298691, H8-120388, and H6-212338, referred to as Patent Documents 1 to 3, respectively).

Patent Document 1 discloses an Al—Zn—Mg aluminum alloy extruded shape for a motorcycle constructional member in which thickness of a recrystallized layer on a surface is reduced to no greater than 50 μm. It is described that it is possible for the extruded shape to undergo shaping such as a swaging process and a bending process in a high deformation region by: (a) preventing surface roughening of the shape by adding a recrystallization inhibitor such as Mn, Zr, and Cr to suppress formation of the surface recrystallized layer; and (b) reducing an amount of Mg to 0.20 to 0.50% by weight to improve elongation (paragraph 0009).

Patent Document 2 discloses an Al—Zn—Mg aluminum alloy hollow shape in which an interior structure is mainly a fiber-like structure and bending processability is improved by reducing thickness of a recrystallization structure on a surface part of the shape to smaller than 50 μm. It is disclosed that formation of the surface coarse recrystallized layer is suppressed by suppressing recrystallization by adding 0.2 to 0.5% Mn and quickly chilling the hollow shape immediately after extrusion by liquid nitrogen spraying.

Patent Document 3 discloses an Al—Zn—Mg aluminum alloy hollow shape having superior strength and shapability in which all of the metallographic structure is composed of a fiber-like structure. It is disclosed that recrystallization is suppressed by adding Zr, Mn, and Cr.

Patent Document 1: Japanese Unexamined Patent Application, Publication No. H10-298691

Patent Document 2: Japanese Unexamined Patent Application, Publication No. H8-120388

Patent Document 3: Japanese Unexamined Patent Application, Publication No. H6-212338

SUMMARY OF THE INVENTION

The 7000 series aluminum alloy extrusion material is used for a constructional member for automobiles and two wheel vehicles, leveraging its superior proof stress and lightweight properties. For example, products such as a bumper reinforcement, a door impact beam and the like of automobiles have complex cross-sectional shapes and require a large bending process of an extrusion material to be shaped into predetermined shapes. In addition, when used for a constructional member for automobiles and two wheel vehicles, the extrusion material is required not to break early even under a great bending stress in a case of accident, while deformation is acceptable, for protection of passengers.

However, when the 7000 series aluminum alloy extrusion material is subjected to a bending process, crack and defect of uneven surface such as orange peel may occur. Such insufficient bending processability leads to limitations in products and uses to which the material is applicable. In addition, in a case of fiber-like structure, a shear stress generated during bending cannot be distributed (resolved) and a crack tends to run in one direction, leading to a risk of breakage of the constructional material. A 7000 series aluminum alloy extrusion material composed of a fiber-like structure, which has shapability and strength obtained by suppressing formation of a recrystallized layer on a surface, such as those disclosed in Patent Documents 1 to 3 has been proposed; however, depending on use, a member having bending processability and strength corresponding thereto has been required. Furthermore, in a case in which only the surface part is composed of a recrystallized structure, when a great bending force is applied to a member in a case of an accident and the like and a crack reaches the fiber-like structure, the crack may continue to run and lead to breakage.

The present invention has been made in view of the abovementioned problems, and an objective of the present invention is to provide a high proof stress aluminum alloy extrusion material having superior bendability and crack resistance.

As a result of extensive research, the inventor has unexpectedly found that, by composing a major part of a metallographic structure of a 7000 series aluminum alloy extrusion material of a recrystallized structure instead of a conventional fiber-like structure, bendability is better than one composed of the fiber-like structure. Based on the finding, the inventor has discovered that an aluminum alloy extrusion material superior in bending processability which prevents a crack and a surface defect even in a case of bending process of a high degree of processing, and superior in bendability which prevents breakage even in a case of large deformation under a force in an accident and the like can be obtained.

Furthermore, in terms of the effect of formation of a recrystallized structure on mechanical strength, the inventor has discovered that an aluminum alloy extrusion material having such high proof stress in which no practical problem is caused can be obtained, by controlling contents of alloy elements and inevitable impurities to be in appropriate ranges.

In a first aspect of the present invention, a high proof stress aluminum alloy extrusion material superior in bendability and crack resistance is of an aluminum alloy including: 5.0 to 7.0 wt % of Zn; 0.5 to 1.5 wt % of Mg; 0.05 to 0.3 wt % of Cu; no greater than 0.15 wt % of Zr; 0.1 to 0.4 wt % of Fe; 0.05 to 0.4 wt % of Si; and the balance being Al and inevitable impurities, in which at least 90% of a metallographic structure is a recrystallized structure.

A major part, including an interior structure, of the metallographic structure of aluminum alloy in the extrusion material of the present invention is composed of a recrystallized structure and only a little fiber-like structure is included. An aluminum alloy entirely composed of a recrystallized structure has superior deformability to that composed of a fiber-like structure, and allows for a large bending process. Such an aluminum alloy also has preferable bendability and crack resistance, suppressing breakage even in a case of large deformation under rapid and large bending stress in an accident and the like.

A major part of the metallographic structure can be composed of a recrystallized structure by restricting a content of Zr, which is an element having an effect of suppressing recrystallization, to under a predetermined level. In terms of the effect of recrystallization on mechanical strength, necessary proof stress can be secured by adding predetermined amounts of Zn, Mg, Cu, Fe, and Si.

According to a second aspect of the present invention, in the high proof stress aluminum alloy extrusion material as described in the first aspect, the aluminum alloy comprises at least one of: 0.05 to 0.08 wt % of Zr; 0.05 to 0.35 wt % of Cr; 0.05 to 0.2 wt % of Mn; 0.005 to 0.12 wt % of Ti; and 0.003 to 0.1 wt % of B.

Coarsening of the recrystallized structure can be suppressed by adding Zr, Cr, and Mn, which are elements having an effect of suppressing grain coarsening due to recrystallization, in predetermined amounts.

According to a third aspect of the present invention, in the high proof stress aluminum alloy extrusion material as described in the first or second aspect, an average crystal particle diameter of the recrystallized structure is no greater than 500 μm.

Since the recrystallized structure is finely formed, surface roughening can be suppressed even after a bending process and a superior appearance is provided. In addition, lowering of mechanical strength can be suppressed.

According to a fourth aspect of the present invention, the high proof stress aluminum alloy extrusion material as described in any one of the first to third aspects has been subjected to a bending process.

In a fifth aspect of the present invention, a manufacturing method of the high proof stress aluminum alloy extrusion material as described in any one of the first to fourth aspects, includes: a step of homogenization by heating and holding a billet of the aluminum alloy at 450 to 560° C. for 1 to 16 hours and then cooling to an ambient temperature; a step of obtaining the extrusion material by heating the billet to 400 to 570° C. and extruding at an extrusion rate of 2 to 50 m/min; and a step of aging treatment by heating the extrusion material to 110 to 200° C. and holding for 4 to 24 hours.

A high proof stress aluminum alloy extrusion material superior in bendability can be produced by performing homogenization, extrusion, and aging on a billet of aluminum alloy under predetermined conditions. By using aluminum alloy with a limited content of recrystallization suppressing elements and extruding at a high temperature, a recrystallized structure can be obtained in an entire structure of the extrusion material. The aging for increasing the mechanical strength can be performed in one stage.

In a sixth aspect of the present invention, a manufacturing method of the high proof stress aluminum alloy extrusion material as described in any one of the first to fourth aspects includes: a step of homogenization by heating and holding a billet of the aluminum alloy at 450 to 560° C. for 1 to 16 hours and then cooling to an ambient temperature; a step of obtaining the extrusion material by heating the billet to 400 to 570° C. and extruding at an extrusion rate of 2 to 50 m/min; and a step of aging treatment by, in a first stage, performing pre-aging by heating the extrusion material to 90 to 120° C. and holding for 4 to 20 hours, and then, in a second stage, heating to 110 to 200° C., a higher temperature than a holding temperature in the first stage, to thereby hold for 4 to 24 hours as a total holding time of the first and second stages.

A high proof stress aluminum alloy extrusion material superior in bendability can be produced by performing homogenization, extrusion, and aging on a billet of aluminum alloy under predetermined conditions. As the aging treatment, two stage aging can be employed.

According to a seventh aspect of the present invention, the manufacturing method of the high proof stress aluminum alloy extrusion material as described in the fifth or sixth aspect, further includes a step of performing a bending process on the extrusion material having been subjected to the aging treatment.

The high proof stress aluminum alloy extrusion material of the present invention is composed of an aluminum alloy containing predetermined amounts of Zn and Mg. By composing at least 90% of the metallographic structure of the alloy of a recrystallized structure, bendability and bending processability can be improved, and proof stress and tensile strength equivalent to those of conventional materials can be obtained. The material can therefore be employed in products of complex shapes, which require bending processes of high degree, and contributes to weight saving of vehicles. In addition, the material does not break early and contributes to protection and safety of passengers.

The aluminum alloy extrusion material of the present invention can be employed in, for example, a bumper reinforcement, a roof rail, a door impact beam, a seat rail, members such as a side member, and a side sill for vehicles; an automobile frame; an automobile handle; and a bicycle rim. The material is suitable for extrusion materials having complex shapes having cross-sectional shapes with a hollow part or a semi-hollow part with a high tongue ratio.

DETAILED DESCRIPTION OF THE INVENTION

Figure 1A:
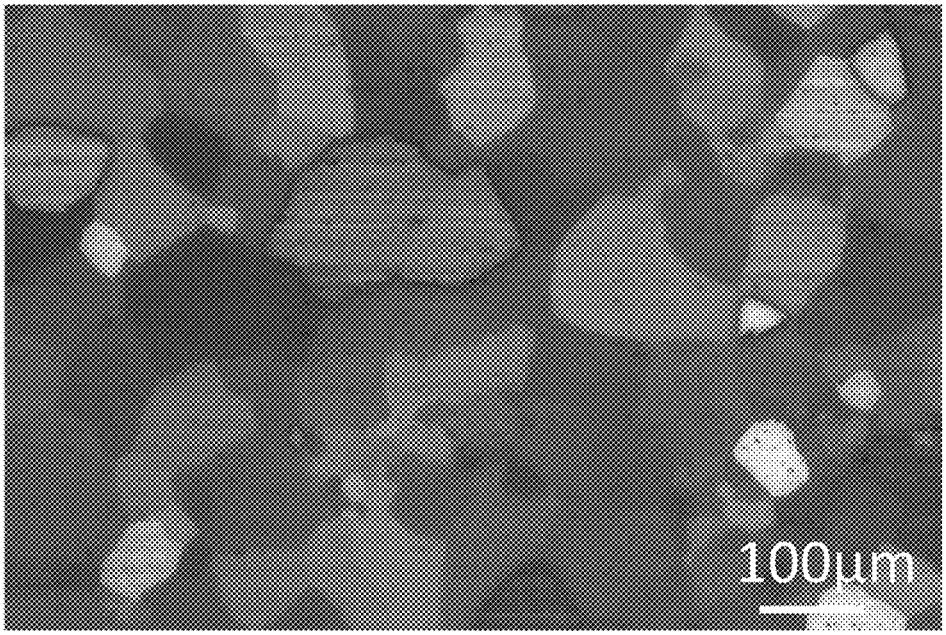
FIG. 1(*a*) is a diagram showing a metallographic structure and (*b*) is a diagram showing a cross-sectional shape after a bending test of an alloy extrusion material of an Example of the present invention.

The high proof stress aluminum alloy extrusion material and a manufacturing method thereof according to the present invention are described in detail hereafter.

(Recrystallized Structure)

A major part, including an interior structure, of the metallographic structure of aluminum alloy in the high proof stress aluminum alloy extrusion material of the present invention is composed of a recrystallized structure and only a little fiber-like structure is included. By composing the entire structure of a recrystallized structure, a high bending limit strain of at least 30% can be obtained. Therefore, a bending process of a high degree of processing is possible since a surface defect such as a crack and a flaw is not produced on a surface of a working material even after a bending process of a high degree. In addition, breakage of the working material can be suppressed even under an excessive bending stress due to unexpected trouble. The proportion of the recrystallized structure is preferably at least 90%.

Next, component elements in the aluminum alloy used in the present invention, and contents thereof are described.

Zn is a component having an effect of improving mechanical strength by means of solid solution strengthening and precipitation strengthening in cooperation with Mg. A content lower than 5.0 wt % does not provide sufficient mechanical strength, and a content greater than 7.0 wt % lowers corrosion resistance. A content from 5.0 wt % to 7.0 wt % is therefore required.

Mg is also a component having an effect of improving mechanical strength by means of solid solution strengthening and precipitation strengthening. A content lower than 0.5 wt % does not provide sufficient strength, and a content greater than 1.5 wt % increases deformation resistance which leads to lowering of extrudability and corrosion resistance. A content from 0.5 wt % to 1.5 wt % is therefore required.

Cu is a component having an effect of improving mechanical strength by means of solid solution strengthening and precipitation strengthening. A content lower than 0.05 wt % does not provide sufficient mechanical strength, and a content greater than 0.3 wt % lowers corrosion resistance. A content from 0.05 wt % to 0.3 wt % is therefore required. A content from 0.15 wt % to 0.25 wt % is preferable.

Zr is an element having an effect of suppressing recrystallization, and the content thereof needs to be restricted to no greater than 0.15 wt %. However, Zr has an effect of forming a fine structure by suppressing grain coarsening in a region of recrystallization, and is acceptable in such a range that bending processability and mechanical strength are not impaired. A content from 0.05 wt % to 0.08 wt % is preferable.

Fe has an effect of contributing to improvement of mechanical strength and refinement of the recrystallized structure. This effect is remarkable when the content is at least 0.1 wt %; however, a content greater than 0.4 wt % generates a coarsened compound (Al—Fe—Si compound) from which breakage may occur, lowering mechanical strength. In order to suppress the Fe content to lower than 0.1 wt %, high purity aluminum metal, which is a factor of increased cost, is required. A content from 0.1 wt % to 0.4 wt % is therefore preferable.

Si has an effect of contributing to improvement of mechanical strength and refinement of the recrystallized structure. A content greater than 0.4 wt % generates a coarsened compound (Al—Fe—Si compound) from which breakage may occur, lowering mechanical strength. A content from 0.05 wt % to 0.4 wt % is therefore preferable.

Cr and Mn are elements having an effect of suppressing grain coarsening of the recrystallized structure by coexisting and crystallizing out as a compound in a matrix. If an amount thereof being added is too small, the effect is insufficient; on the other hand, if the amount is too large, the crystallized compound coarsens and becomes a starting point of breakage, lowering mechanical strength. It is preferable that the content of Cr is 0.05 to 0.25 wt %, and the content of Mn is 0.05 to 0.02 wt %.

Ti and B are elements contributing to refinement of a cast structure and have an effect of improving deformability and extrudability. If an amount thereof being added is too small, the effect is insufficient; on the other hand, if the amount is too large, a TiB compound which becomes a starting point of breakage is formed, lowering mechanical strength. It is preferable that the content of Ti is 0.005 to 0.12 wt %, and the content of B is 0.003 to 0.1 wt %.

(Inevitable Impurities)

Inevitable impurities other than the above described elements are allowed to be included in such a range that characteristics of the aluminum alloy extrusion material of the present invention are not impaired. More specifically, no greater than 0.05 wt % of inevitable impurities in total is allowable.

A manufacturing method of the high proof stress aluminum alloy extrusion material according to the present invention is described hereafter.

(Casting and Homogenization)

A billet is produced by general smelting, a molten metal process, and then a semi-continuous casting method (DC casting). The billet is subjected to homogenization. Homogenization is a treatment for homogenizing the cast structure by eliminating segregation in the cast structure and dissolving the alloy elements and the coarsened compound. In the present invention, the billet is subjected to homogenization of at least 1 hour at a temperature of 450 to 560° C., and then cooled to room temperature. A homogenization temperature lower than 450° C. or homogenization of less than 1 hour leads to insufficient homogenization; on the other hand, a homogenization temperature higher than 560° C. is not preferable since burning (partial fusion) may be caused.

(Extrusion Process)

And then, the billet is hot extruded to manufacture an extrusion material of predetermined dimensions. In the present invention, the billet is heated to a temperature of 400 to 570° C. and hot extruded at a product rate of 2 to 50 m/min at a platen exit of an extruder, and an extrusion material thus obtained is cooled to room temperature at a rate of at least 50° C./min until 100° C.

The extrusion temperature is preferably a high temperature of at least 400° C., in order to allow an extrusion process of a thin-walled member and the like with a high extrusion ratio, and allow recrystallization to proceed by means of strain applied by the extrusion process. If the extrusion temperature is higher than 570° C., the member is easily deformed and the strain, a driving force required for recrystallization, is not sufficiently accumulated during the extrusion process. The temperature is therefore preferably in a range of 400 to 570° C.

If the extrusion rate is lower than 2 m/min, the strain, a driving force required for recrystallization, is not sufficiently accumulated and a fiber-like structure tends to remain since the recrystallized structure is not sufficiently formed. On the other hand, if the extrusion rate is higher than 50 m/min, a deformation rate becomes high, leading to deterioration of shape accuracy and surface texture of a product.

After the extrusion process, the extrusion material is quickly chilled in order to prevent coarsening of recrystallized grain and to thereby maintain a fine recrystallized structure. The extrusion material is chilled preferably at a rate of at least 50° C./min, more preferably at a rate of 200° C./min, until 100° C.

(Aging Treatment)

Thereafter, the extrusion material cooled to an ambient temperature is cut into a predetermined length or corrected, and then subjected to artificial aging treatment. The artificial aging treatment disperses and precipitates a compound, which contributes to strength, in a matrix texture and is performed by maintaining a temperature range of 110 to 200° C., preferably 120 to 150° C., for a predetermined period of time. As a result of this treatment, required strength is provided to the extrusion material while maintaining high bendability.

The aging treatment can be performed in one stage; however, two stage aging is more preferable. In the case of two stage aging, a first stage for pre-aging takes place at 90 to 120° C., preferably at 95 to 115° C.; and then a second stage takes place at the abovementioned temperature range of 110 to 200° C., which is higher than that of the first stage. A temperature lower than the lower limit of the abovementioned temperature range leads to insufficient generation and growth of precipitate, and insufficient strength. A temperature higher than the upper limit of the abovementioned temperature range leads to precipitation of a coarse compound and impairs shapability and corrosion resistance. Time required for the artificial aging treatment is 4 to 24 hours in total. In the case of two stage aging, aging time is distributed as appropriate between the first stage and the second stage. If the aging time is too short, sufficient strength cannot be obtained. If the aging time is too long, the material is overaged and strength and productivity are lowered.

(Method of Bending Process)

A method of bending process is not particularly limited. Any method normally used for bending process of an aluminum extrusion material, such as bender bending process, can be used. Rotary bending process, compression bending process, roller bending process, press bending process, stretch bending process, push-through bending process and the like can be employed.

EXAMPLES

The present invention is described hereinafter based on Examples. It should be noted that the present invention is not limited to the following Examples and can be modified as appropriate within a scope of the present invention.

Example 1

Molten metal of Examples (alloys No. 1 to No. 24) and Comparative Examples (alloys No. 25 to No. 42) having alloy compositions shown in Tables 1 and 2 were prepared, and billets having a substantially cylindrical shape of 8 inch in diameter were produced by DC casting. After holding at 480° C. for 4 hours, the billets thus obtained were subjected to homogenization by fan air cooling. Thereafter, the billets were hot extruded at the extrusion rate and extrusion temperature shown in Tables 1 and 2 by means of an extruder, to thereby obtain extrusion materials having a planar shape (100 mm in width and 2 mm in thickness). In this process, from immediately after extrusion, the extrusion materials were chilled almost to a room temperature by fan air cooling, by means of a cooling device arranged at an exit of the extruder. After cutting the extrusion materials into 4500 mm, test samples were obtained by performing the artificial aging treatment at temperatures and durations shown in Tables 1 and 2. After extrusion, the alloy No. 3 was not fan air cooled but allowed to cool (cooling rate lower than 50° C./min) to a room temperature, in order to coarsen the recrystallized structure.

TABLE 1

Composition of aluminum alloy extrusion material

| | Alloy No. | Composition wt % Si | Fe | Cu | Mg | Zn | Zr | Ti | Cr | Mn | B | Homogenization | Extrusion: Billet Temperature (° C.) | Extrusion: Extrusion Rate (m/min) | Aging Treatment: First Stage | Aging Treatment: Second Stage | Alloy No. |
|---|---|---|---|---|---|---|---|---|---|---|---|---|---|---|---|---|---|
| Examples of Present Invention | 1 | 0.04 | 0.06 | 0.16 | 0.82 | 6.2 | — | 0.03 | — | — | — | 480° C. × 4 hr | 500 | 6 | 105° C. × 8 hr | 150° C. × 8 hr | 1 |
| | 2 | 0.04 | 0.06 | 0.16 | 0.82 | 6.2 | — | 0.03 | — | — | — | | 500 | 35 | | | 2 |
| | 3 | 0.08 | 0.17 | 0.17 | 0.87 | 6.4 | 0.05 | 0.04 | — | — | — | | 500 | 6 | | | 3 |
| | 4 | 0.08 | 0.17 | 0.18 | 0.88 | 6.3 | — | 0.04 | — | — | — | | 520 | 2 | | | 4 |
| | 5 | 0.08 | 0.17 | 0.17 | 0.87 | 6.4 | 0.05 | 0.04 | — | — | — | | 520 | 2 | | | 5 |
| | 6 | 0.08 | 0.17 | 0.22 | 1.2 | 6.6 | — | 0.03 | — | — | — | | 480 | 6 | | | 6 |
| | 7 | 0.08 | 0.17 | 0.18 | 0.88 | 6.2 | 0.05 | 0.03 | 0.02 | 0.02 | 0.01 | | 480 | 6 | | | 7 |
| | 8 | 0.08 | 0.17 | 0.17 | 0.87 | 6.4 | 0.05 | 0.04 | — | — | — | | 500 | 6 | 160° C. × 10 hr | — | 8 |
| | 9 | 0.38 | 0.17 | 0.17 | 0.87 | 6.4 | 0.05 | 0.04 | — | — | — | | | | | | 9 |
| | 10 | 0.08 | 0.1 | 0.17 | 0.87 | 6.4 | 0.05 | 0.04 | — | — | — | | | | | | 10 |
| | 11 | 0.08 | 0.38 | 0.17 | 0.87 | 6.4 | 0.05 | 0.04 | — | — | — | | | | | | 11 |
| | 12 | 0.08 | 0.17 | 0.06 | 0.87 | 6.4 | 0.05 | 0.04 | — | — | — | | | | | | 12 |
| | 13 | 0.08 | 0.17 | 0.28 | 0.87 | 6.4 | 0.05 | 0.04 | — | — | — | | | | | | 13 |
| | 14 | 0.08 | 0.17 | 0.18 | 0.6 | 6.4 | 0.05 | 0.04 | — | — | — | | | | | | 14 |
| | 15 | 0.08 | 0.17 | 0.18 | 1.5 | 6.4 | 0.05 | 0.04 | — | — | — | | | | | | 15 |
| | 16 | 0.08 | 0.17 | 0.18 | 0.88 | 5.2 | 0.05 | 0.04 | — | — | — | | | | | | 16 |
| | 17 | 0.08 | 0.17 | 0.18 | 0.88 | 6.8 | 0.05 | 0.04 | — | — | — | | | | | | 17 |
| | 18 | 0.08 | 0.17 | 0.18 | 0.88 | 6.2 | 0.05 | 0.04 | — | — | — | | | | | | 18 |
| | 19 | 0.08 | 0.17 | 0.18 | 0.88 | 6.2 | 0.07 | 0.04 | — | — | — | | | | | | 19 |
| | 20 | 0.08 | 0.17 | 0.18 | 0.88 | 6.2 | 0.05 | 0.04 | 0.06 | — | — | | | | | | 20 |

TABLE 1-continued

| Composition of aluminum alloy extrusion material | | | | | | | | | | | | | | | | |
|---|---|---|---|---|---|---|---|---|---|---|---|---|---|---|---|---|
| | | | | | | | | | | | | Extrusion | | Aging | | |
| | | | | | | | | | | | Homo- | Billet | Extrusion | Treatment | | |
| | Alloy | Composition wt % | | | | | | | | | geni- | Temperature | Rate | First | Second | Alloy |
| | No. | Si | Fe | Cu | Mg | Zn | Zr | Ti | Cr | Mn | B | zation | (° C.) | (m/min) | Stage | Stage | No. |
| | 21 | 0.08 | 0.17 | 0 18 | 0.88 | 6.2 | 0.05 | 0.04 | 0.25 | — | — | | | | | | 21 |
| | 22 | 0.08 | 0.17 | 0.18 | 0.88 | 6.2 | 0.05 | 0.04 | 0.02 | 0.10 | — | | | | | | 22 |
| | 23 | 0.08 | 0.17 | 0.18 | 0.88 | 6.2 | 0.05 | 0.04 | 0.02 | 0.35 | — | | | | | | 23 |
| | 24 | 0.08 | 0.17 | 0.18 | 0.88 | 6.2 | 0.05 | 0.01 | 0.02 | 0.02 | — | | | | | | 24 |

TABLE 2

| | | | | | | | | | | | | | | | | | |
|---|---|---|---|---|---|---|---|---|---|---|---|---|---|---|---|---|---|
| | | | | | | | | | | | | Extrusion | | Aging | | |
| | | | | | | | | | | | Homo- | Billet | Extrusion | Treatment | | |
| | Alloy | Composition wt % | | | | | | | | | geni- | Temperature | Rate | First | Second | Alloy |
| | No. | Si | Fe | Cu | Mg | Zn | Zr | Ti | Cr | Mn | B | zation | (° C.) | (m/min) | Stage | Stage | No. |
| Comparative Examples | 25 | 0.08 | 0.15 | 0.17 | 0.61 | 6.2 | 0.16 | 0.03 | — | — | — | 480° C. × 4 hr | 500 | 6 | 105° C. × 8 hr | 150° C. × 8 hr | 25 |
| | 26 | 0.07 | 0.16 | 0.19 | 0.84 | 6.2 | 0.16 | 0.03 | — | — | — | | | | | 150° C. × 8 hr | 26 |
| | 27 | 0.07 | 0.16 | 0 19 | 0.84 | 6.2 | 0.16 | 0.03 | — | — | — | | | | | 170° C. × 8 hr | 27 |
| | 28 | 0.04 | 0.04 | 0.19 | 0.84 | 6.2 | 0.19 | 0.03 | — | — | — | | | | | 150° C. × 8 hr | 28 |
| | 29 | 0.07 | 0.17 | 0.22 | 1.19 | 6.6 | 0.16 | 0.03 | — | — | — | | | | | 150° C. × 8 hr | 29 |
| | 30 | 0.07 | 0.17 | 0.22 | 1.19 | 6.6 | 0.16 | 0.03 | — | — | — | | | | | 165° C. × 8 hr | 30 |
| | 31 | 0.07 | 0.17 | 0.22 | 1.19 | 6.6 | 0.16 | 0.03 | — | — | — | | | | | 175° C. × 8 hr | 31 |
| | 32 | 0.07 | 0.17 | 0.22 | 1.19 | 6.6 | 0.16 | 0.03 | — | — | — | | | | | 195° C. × 0.5 hr | 32 |
| | 33 | 0.07 | 0.17 | 0.22 | 1.19 | 6.6 | 0.16 | 0.03 | — | — | — | | | | 120° C. × 4 hr | — | 33 |
| | 34 | 0.07 | 0.17 | 0.22 | 1.19 | 6.6 | 0.16 | 0.03 | — | — | — | | | | 120° C. × 10 hr | — | 34 |
| | 35 | 0.6 | 0.17 | 0.18 | 0.88 | 6.2 | 0.05 | — | 0.02 | 0.02 | — | | | | 105° C. × 8 hr | 105° C. × 8 hr | 35 |
| | 36 | 0.08 | 0.5 | 0.18 | 0.88 | 6.2 | 0.05 | — | 0.02 | 0.02 | — | | | | | | 36 |
| | 37 | 0.08 | 0 17 | 0.03 | 0.88 | 6.2 | 0.05 | — | 0.02 | 0.02 | — | | | | | | 37 |
| | 38 | 0.08 | 0.17 | 0.4 | 0.88 | 6.2 | 0.05 | — | 0.02 | 0.02 | — | | | | | | 38 |
| | 39 | 0.08 | 0.17 | 0.18 | 0.3 | 6.2 | 0.05 | — | 0.02 | 0.02 | — | | | | | | 39 |
| | 40 | 0.08 | 0.17 | 0.18 | 1.7 | 6.2 | 0.05 | — | 0.02 | 0.02 | — | | | | | | 40 |
| | 41 | 0.08 | 0.17 | 0.18 | 0.88 | 4 | 0.05 | — | 0.02 | 0.02 | — | | | | | | 41 |
| | 42 | 0.08 | 0.17 | 0.18 | 0.88 | 8 | 0.05 | — | 0.02 | 0.02 | — | | | | | | 42 |

NB: Underlines indicate departures from the range of present invention)

By using these test samples, the metallographic structure was observed, and measurements and tests were performed for evaluation of the proportion of the recrystallized structure, an average crystal grain size, mechanical properties, and corrosion resistance.

(Proportion of Recrystallized Structure, Average Crystal Grain Size)

A test piece (20 mm in length and 2 mm in thickness) for observation was obtained from the test sample, a cross-section thereof which is horizontal to an extrusion direction was mirror polished and then etched, and a sectional structure thereof was observed by a metallograph.

In addition, using a test piece of Example of the present invention, the proportion of the recrystallized structure was measured on the cross-section which is horizontal to the extrusion direction. The proportion (%) of the recrystallized structure was calculated based on a proportion of a thickness of the recrystallized structure, which is measured on an observed image or a photograph of an entire vertical cross-section of the test piece taken by the metallograph, to a total thickness of the sample. In the test piece, the recrystallized structures were formed respectively from upper and lower surfaces of the cross-section. Thicknesses of the recrystallized structures were measured as Δt1 and Δt2, and the proportion of the recrystallized structures was calculated by (Δt1+Δt2)/total thickness.

And then, the average crystal grain size (μm) in the test piece was measured. The average crystal grain size (μm) was measured in conformance with the cutting method defined in JISH0501. With the cutting method, the average crystal grain size is obtained by: drawing a straight line in a predetermined region in an observed image or a photograph of crystal grains; and calculating an average cut length based on a length of the straight line and the number of crystal grains being cut by the straight line.

(Tensile Test)

A No. 5 test piece of JISZ2201 (25 mm in width and 50 mm in length) was obtained from the test sample, and tensile strength (MPa), proof stress (MPa), and extension (%) were measured by performing a tensile test in room temperature air, at a tensile rate of 5 ram/min. The test piece was obtained such that a tensile direction thereof is the extrusion direction.

(Bending Test)

A plate-like No. 3 test piece (100 mm in length, 50 mm in width, and original thickness of the sample (2.0 mm)) was obtained from the test sample in conformance with JISZ2248, and a bending test was performed by the pressing bend method. In a state in which a lower surface of the test piece was supported by cylindrical shaped supporting parts at two positions along a longitudinal direction, a pressing metal member was brought into contact with an upper surface of the test piece in the vicinity of a middle point between the two positions, to thereby bend the test piece under load. An outer side of a curved part of the test piece was observed by unaided eyes, and a bending limit strain (%), which is a bending angle upon generation of a defect such as rupture, was measured.

Figure 4:
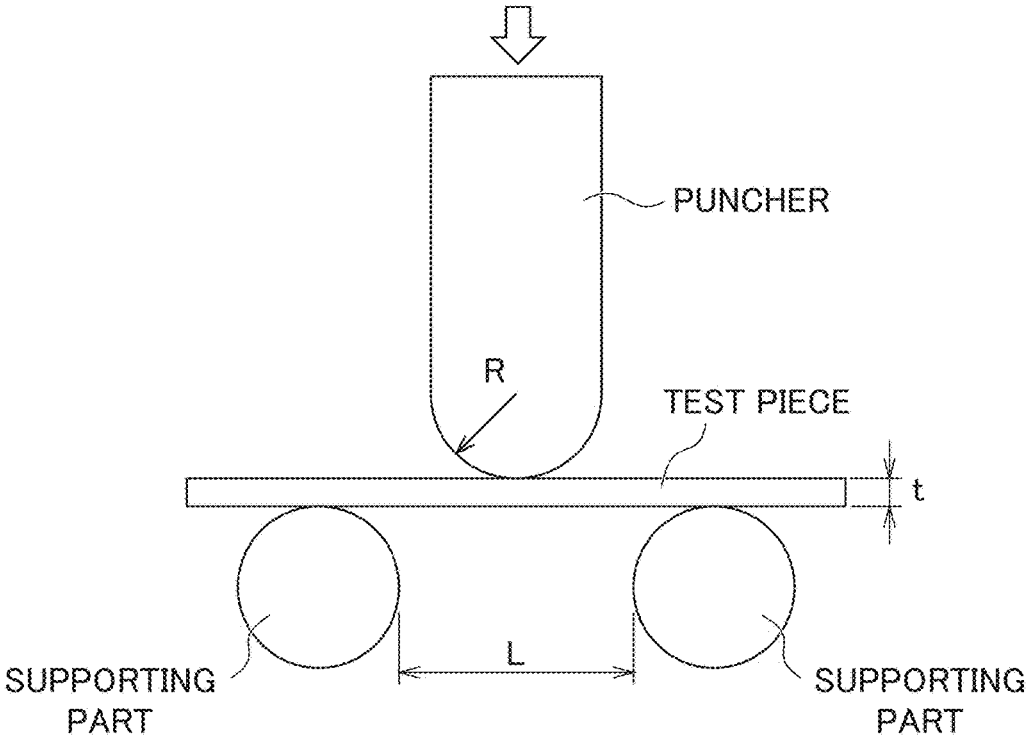
FIG. 4 is a diagram schematically showing the bending test.

A schematic diagram of the bending test is shown in FIG. 4. In the bending test, supporting parts of 30 mm in diameter were arranged at an interval L=2R+2t (with tolerance of ±0.2 mm), with R being a curvature of a puncher and t being a thickness of the test piece. The puncher was brought into close contact with the test piece, and the test piece was bent until a horizontal part of the puncher passed through the supporting parts. The test was repeated while changing the curvature R of the puncher, until press bending of 180° without causing damage to the curved part of the test piece became possible. The smallest R allowing close-contact bending by press bending of 180° is the bending limit. The bending limit strain (ε) was calculated by ε (%)=t/(2R+t)×100. In the present bending test, a puncher up to 58% bending limit strain was used.

(Corrosion Resistance Test)

Corrosion resistance was evaluated by a JASOM609-1CCT compound cyclic test. A cycle consists of performing on a test sample: (1) salt spray (35° C., 90% moisture, 5% NaCl) for 2 hours; (2) drying (60° C., 30% moisture) for 4 hours; and then (3) moistening (50° C., 95% moisture) for 2 hours. After performing 90 cycles of (1) to (3) (over approximately 30 days), the test piece was boiled in a chromium phosphate aqueous solution for 10 minutes, to thereby eliminate corrosive organisms. Thereafter, a cross-section of the test piece was observed. A case with a corrosion depth no greater than 100 μm was evaluated as good and a case with corrosion depth greater than 100 μm was evaluated as poor.

Test results are shown in Tables 3 and 4.

TABLE 3

| | Alloy No. | Major structure | Proportion of Recrystallized Structure | Average Crystal Grain Size (μm) | Tensile Strength (MPa) | Proof Stress (MPa) | Extension (%) | Bending Limit Strain (%) | Corrosion Resistance |
|---|---|---|---|---|---|---|---|---|---|
| Examples of Present Invention | 1 | RC | 100% | 67 | 376 | 350 | 15.3 | >58 | ○ |
| | 2 | RC | 100% | 102 | 375 | 348 | 13.2 | >58 | ○ |
| | 3 | RC | 100% | 720 | 351 | 318 | 18.9 | 31 | ○ |
| | 4 | RC | 94% | 228 | 374 | 340 | 18.9 | 39 | ○ |
| | 5 | RC | 96% | 107 | 370 | 344 | 18.2 | 38 | ○ |
| | 6 | RC | 100% | 58 | 424 | 404 | 18 | 36 | ○ |
| | 7 | RC | 98% | 46 | 435 | 414 | 18 | 37 | ○ |
| | 8 | RC | 100% | 58 | 421 | 403 | 17.3 | 39 | ○ |
| | 9 | RC | 100% | 68 | 361 | 346 | 16.3 | 44 | ○ |
| | 10 | RC | 100% | 107 | 388 | 353 | 18.2 | >58 | ○ |
| | 11 | RC | 100% | 54 | 370 | 335 | 17.2 | 50 | ○ |
| | 12 | RC | 100% | 62 | 372 | 347 | 16.2 | >58 | ○ |
| | 13 | RC | 100% | 58 | 381 | 355 | 16.4 | >58 | ○ |
| | 14 | RC | 100% | 82 | 351 | 321 | 18.7 | >58 | ○ |
| | 15 | RC | 100% | 66 | 398 | 361 | 15.8 | 48 | ○ |
| | 16 | RC | 100% | 62 | 349 | 326 | 19.6 | >58 | ○ |
| | 17 | RC | 100% | 61 | 404 | 364 | 16.8 | 48 | ○ |
| | 18 | RC | 100% | 54 | 381 | 352 | 16.2 | >58 | ○ |
| | 19 | RC | 100% | 46 | 394 | 356 | 15.6 | >58 | ○ |
| | 20 | RC | 100% | 56 | 383 | 351 | 15.9 | >58 | ○ |
| | 21 | RC | 96% | 37 | 398 | 355 | 16.7 | >58 | ○ |
| | 22 | RC | 100% | 72 | 376 | 351 | 16 | >58 | ○ |
| | 23 | RC | 95% | 52 | 383 | 359 | 17.4 | 54 | ○ |
| | 24 | RC | 100% | 75 | 375 | 350 | 18 | >58 | ○ |

* RC represents a recrystallized structure and F represents a fiber-like structure.

* >58% bending limit strain indicates that no crack was generated in a bending test of 180° bending.

* "○" represents good corrosion resistance and "X" represents poor corrosion resistance.

TABLE 4

| | Alloy No. | Major structure | Proportion of Recrystallized Structure | Average Crystal Grain Size (μm) | Tensile Strength (MPa) | Proof Stress (MPa) | Extension (%) | Bending Limit Strain (%) | Corrosion Resistance |
|---|---|---|---|---|---|---|---|---|---|
| Comparative Examples | 25 | F | — | — | 372 | 315 | 19.5 | 28 | ○ |
| | 26 | F | — | — | 427 | 381 | 15.8 | 22 | ○ |
| | 27 | F | — | — | 370 | 330 | 17.3 | 22 | ○ |
| | 28 | F | — | — | 422 | 378 | 16.5 | 26 | ○ |
| | 29 | F | — | — | 486 | 443 | 16.2 | 17 | ○ |
| | 30 | F | — | — | 440 | 398 | 17.2 | 22 | ○ |
| | 31 | F | — | — | 398 | 346 | 16.6 | 22 | ○ |
| | 32 | F | — | — | 421 | 372 | 15.1 | 22 | ○ |
| | 33 | F | — | — | 472 | 367 | 19.1 | 19 | ○ |
| | 34 | F | — | — | 501 | 423 | 18.3 | 16 | ○ |
| | 35 | RC | 95% | 56 | 334 | 294 | 15.6 | >58 | ○ |
| | 36 | RC | 96% | 53 | 297 | 260 | 11.2 | >58 | ○ |
| | 37 | RC | 96% | 80 | 333 | 286 | 20.3 | >58 | ○ |
| | 38 | RC | 95% | 64 | 404 | 364 | 16.8 | 36 | X |
| | 39 | RC | 98% | 87 | 303 | 269 | 21.3 | >58 | ○ |
| | 40 | RC | 96% | 51 | 430 | 411 | 17.4 | 49 | X |
| | 41 | RC | 96% | 67 | 298 | 261 | 23.5 | >58 | ○ |
| | 42 | RC | 97% | 53 | 531 | 483 | 12.8 | 25 | X |

* RC represents a recrystallized structure and F represents a fiber-like structure.
* >58% bending limit strain indicates that no crack was generated in a bending test of 180° bending.
* "○" represents good corrosion resistance and "X" represents poor corrosion resistance.

(Structure)

Figure 1B:
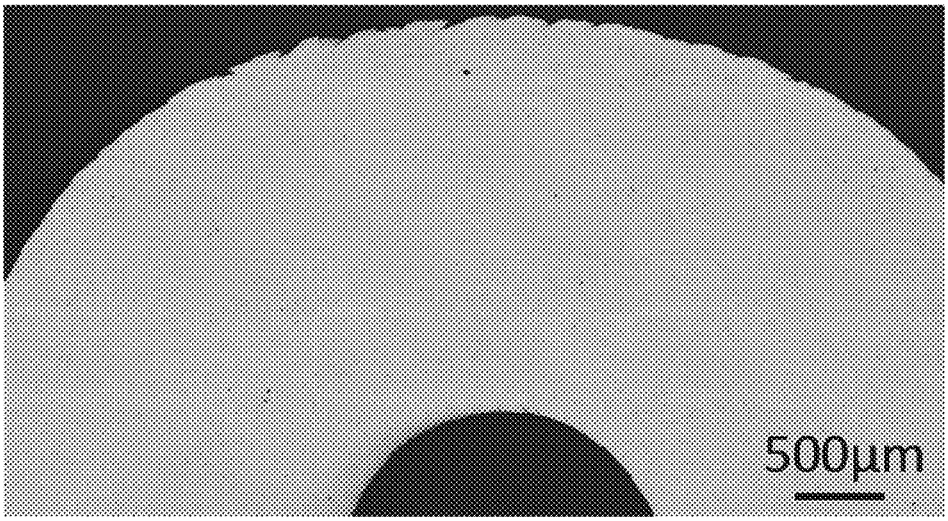

In Tables 3 and 4, RC represents the recrystallized structure and F represents the fiber-like structure. In the alloy materials of Examples of the present invention, a major metallographic structure was the recrystallized structure as shown in Table 1. For example, as shown in FIG. 1(*a*), the alloy No. 1 of Example of the present invention exhibited a fine structure composed of recrystallized grains.

Figure 2A:
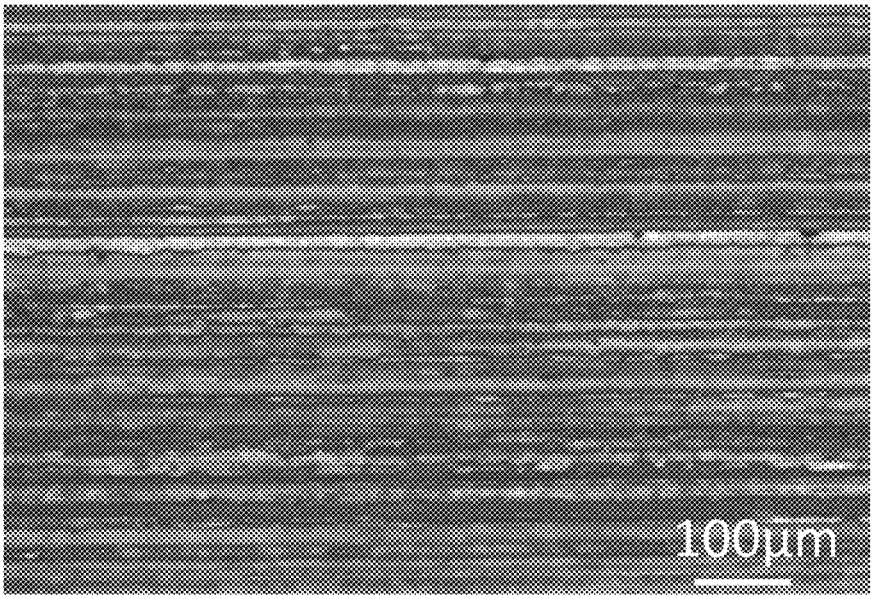
FIG. 2(*a*) is a diagram showing a metallographic structure and (*b*) is a diagram showing a cross-sectional shape after a bending test of an alloy extrusion material of a Comparative Example.
Figure 2B:
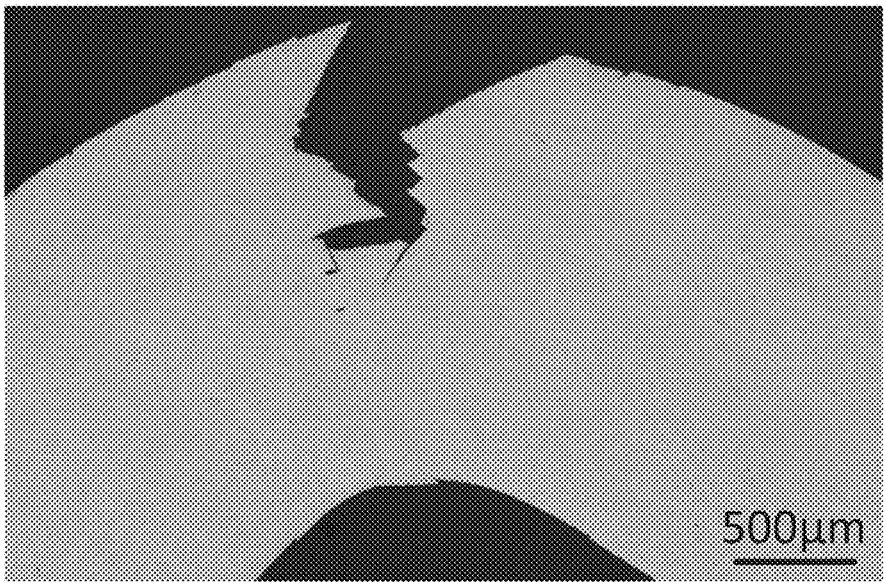

The alloys No. 25 to 34 of Comparative Examples contain 0.16 wt % of Zr, in greater amount than in the alloy of the present invention, recrystallization was suppressed and the fiber-like structure was formed. For example, as shown in FIG. 2(*a*), the alloy No. 25 of Comparative Example exhibited the fiber-like structure extending in the extrusion direction, as in conventional materials. The alloys No. 35 to 42 of Comparative Examples contain 0.05 wt % of Zr, in an amount similar to that of the alloy of the present invention, the recrystallized structure was formed as in Example of the present invention. However, since contents of other components are not within the ranges of Example of the present invention, predetermined mechanical properties could not be obtained (described later).

(Proportion of Recrystallized Structure)

As shown in Table 3, in the alloys No. 1 to 24 of Examples of the present invention, the recrystallized structure occupies at least 90% in an area ratio and composes almost the entire metallographic structure. The fiber-like structure was scarcely present, or only present locally in an inner part. Recrystallization easily proceeds in a surface part, which is in contact with an extrusion die, of the aluminum alloy extrusion material. Example of the present invention, in which a surface layer and an inner part are composed of the recrystallized structure, did not have surface roughening caused by the extrusion process.

(Average Crystal Grain Size)

As shown in Table 3, the recrystallized structure of Examples of the present invention, except for the alloy No. 3, had an average crystal grain size of no greater than 500 μm, exhibiting a fine structure. Coarsening of crystal grain was not caused.

(Tensile Strength, Proof Stress)

As shown in Tables 3 and 4, the alloys No. 1 to 24 of Examples of the present invention have tensile strengths greater than 340 MPa and proof stresses greater than 300 MPa, which are comparable to the alloys No. 25 to 34 of Comparative Examples composed of the fiber-like structure. The alloys have strengths required for machine components, and can be used as practical materials. The alloy No. 3 of which average crystal grain size is large also has a strength required for machine components, although mechanical strength thereof is slightly inferior to the extrusion materials of other Examples of the present invention having small average crystal grain sizes.

(Bending Limit Strain)

Figure 3A:
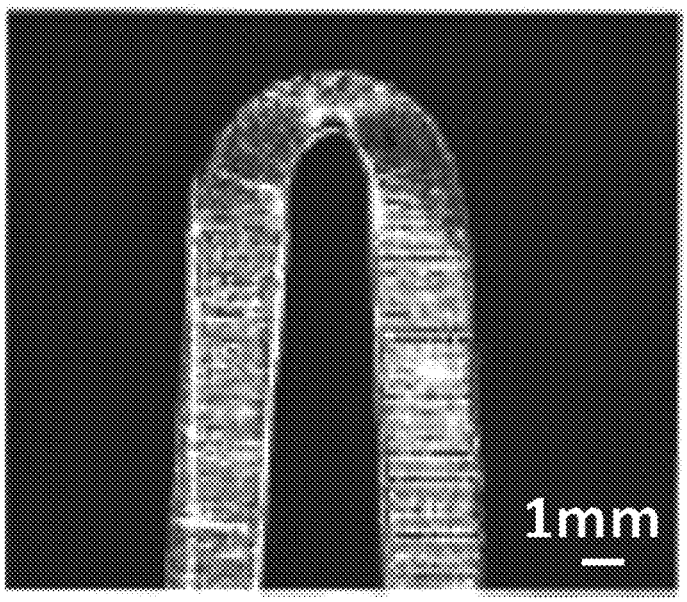
FIG. 3(*a*) is a diagram showing an appearance of a test body of an Example of the present invention and (*b*) is a diagram showing an appearance of a test body of a Comparative Example, after the bending test.
Figure 3B:
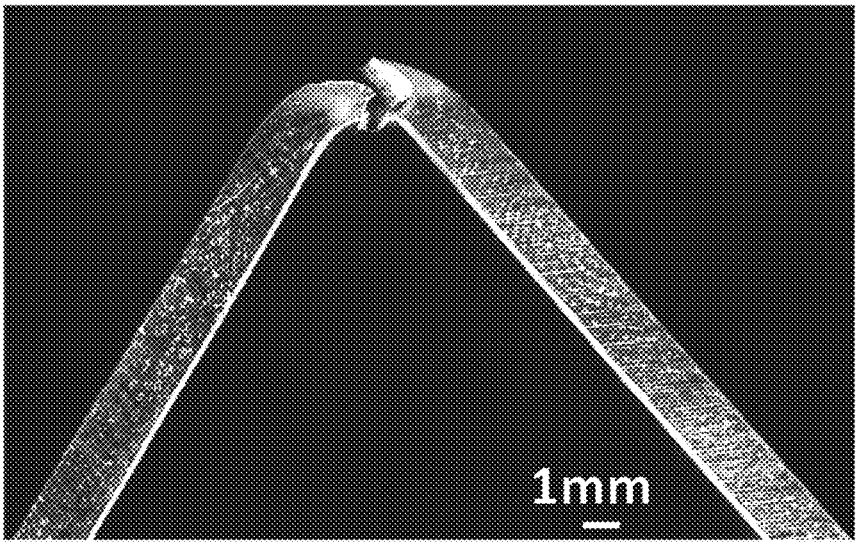

As shown in Tables 3 and 4, the alloys No. 1 to 24 of Examples of the present invention composed of the recrystallized structure exhibited a high bending limit strain of at least 30%. On the other hand, the bending limit strains of the alloys No. 25 to 34 of Comparative Examples composed of the fiber-like structure were lower than 30%. Examples of the present invention had improved bending limit strains and superior bendability compared to Comparative Examples. The alloy No. 3 of Example of the present invention has a grain size of 720 μm and crystal grain thereof is larger than other Examples of the present invention. Therefore the bending limit strain is small, but still greater than Comparative Examples. As shown in FIG. 1(*b*), the alloy material of Examples of the present invention did not have a crack in the curved part even after the bending test. Therefore, the test piece could be largely bent as shown in FIG. 3(*a*).

As described above, Examples of the present invention allows a bending process which imparts a large angle and shaping of the extruded materials into various shapes. Shaping to a nearly final shape by the extrusion process is no longer necessary, and there is more freedom of choice of die and processing conditions, leading to reduced manufacturing cost. In addition, products employing the alloys of Examples of the present invention do not easily break even under an excessive bending stress applied due to unexpected trouble and can secure security of users.

(Corrosion Resistance)

In Tables 3 and 4, "O" represents good corrosion resistance and "X" represents poor corrosion resistance. As shown in Table 3, the alloys of Examples of the present invention all had good corrosion resistance.

COMPARATIVE EXAMPLES

As shown in Table 4, the alloys No. 25 to 34 of Comparative Examples, of which major metallographic structures are composed of the fiber-like structure, had smaller bending limit strain than the alloys of Examples of the present invention. As shown in FIG. 2(*b*), the alloy materials of Comparative Examples having smaller bending limit strain had a crack in the curved part. As a result, the test piece could not be largely bent and was broken as shown in FIG. 3(*b*). As described above, the alloy materials of Comparative Examples were inferior to Examples of the present invention in bendability and crack resistance.

In the alloys No. 35 to 42 of Comparative Examples, a major metallographic structure was composed of the recrystallized structure. However, since the alloy composition is not within the range of Examples of the present invention, these alloys were inferior to Examples of the present invention in proof stress, bending limit strain, or corrosion resistance. The alloy No. 35 had a high Si content and the alloy No. 36 had a high Fe content, leading to generation of coarse crystallized products and having lower proof stress than Examples of the present invention. The alloy No. 37 had a low Cu content leading to low proof stress. The alloy No. 38 had a high Cu content leading to poor corrosion resistance. The alloy No. 39 had a low Mg content leading to low proof stress. The alloy No. 40 had a high Mg content leading to poor corrosion resistance. The alloy No. 41 had a low Zn content leading to low proof stress. The alloy No. 42 had a high Zn content, leading to low bending limit strain and poor corrosion resistance.

Example 2

Billets were produced by the same procedures as Example 1, using molten metal having the same alloy composition as the alloy No. 8 in Table 1. After holding at 480° C. for 4 hours, the billets thus obtained were subjected to homogenization by fan air cooling. Thereafter, the billets were hot extruded at the extrusion rate and extrusion temperature shown in Table 5 by the same procedures as Example 1, and then fan air cooled to room temperature, to thereby obtain extrusion materials having a planar shape (100 mm in width and 2 mm in thickness). After cutting the extrusion materials into 4500 mm, alloys No. 43 to 46 were obtained by performing the artificial aging treatment at temperatures and durations shown in Table 5. And then, tests and measurement with regard to metallographic structure, average crystal grain size, tensile strength, proof stress, extension, bending limit strain, and corrosion resistance were performed by the same procedures as Example 1. Results are shown in Table 5.

As shown in Table 1, the alloy No. 8 of Example of the present invention was obtained by extrusion with the billet of 500° C. and extrusion rate of 6 m/min, and then aging treatment at 160° C. for 10 hours. The alloy No. 8 was composed of the recrystallized structure and superior in proof stress, bending limit strain, and bendability.

On the other hand, as shown in Table 5, the alloy No. 43 resulted in a coarsened surface layer of a product due to high billet temperature and low extrusion rate, while an inner part thereof was the fiber-like structure. The bending limit strain thereof was therefore lower than 30% and bendability was impaired. The alloy No. 44 resulted in partial fusion by frictional heat due to the extrusion rate being too high, leading to fine cracks on the surface layer of the extruded product. The alloy No. 45 was extremely difficult to extrude because of high extrusion deformation resistance caused by the billet temperature being too low. The alloy No. 46 resulted in partial fusion due to the billet temperature being too high, leading to fine cracks on the surface layer of the extruded product. The alloys No. 44 to 46 were not qualified as extrusion products, and therefore not subjected to the aging treatment and evaluation tests.

Given the above results, a high proof stress aluminum alloy having superior bendability can be produced by forming the recrystallized structure by employing the extrusion process and thermal treatment conditions in the manufacturing method of the present invention.

TABLE 5

| | | Extrusion | | Aging Treatment | | | Proportion | | | | Bending |
|---|---|---|---|---|---|---|---|---|---|---|---|
| Alloy No. | Homogenization | Billet Temperature (° C.) | Extrusion Rate (m/min) | First Stage | Second Stage | Major structure | of Recrystallized structure | Tensile Strength (MPa) | Proof Stress (MPa) | Extension (%) | Limit Strain |
| 43 | 480° C. × 4 hr | 580 | 1 | 105° C. × 8 hr | 150° C. × 8 h | Recrystallized structure in surface layer Fiber-like structure in inner part | 23% | 401 | 377 | 15.8 | 24 |
| 44 | | 500 | 55 | — | — | | — | — | — | — | — |
| 45 | | 380 | 6 | — | — | — | — | — | — | — | — |
| 46 | | 580 | 6 | — | — | — | — | — | — | — | — |

(NB: "—" indicates absence of treatment or test)

What is claimed is:

1. An aluminum alloy extrusion material including an aluminum alloy comprising: 5.0 to 7.0 wt % of zinc; 0.5 to 1.5 wt % of magnesium; 0.05 to 0.3 wt % of copper; no greater than 0.15 wt % of zirconium; 0.1 to 0.4 wt % of iron; 0.05 to 0.4 wt % of silicon; 0.005 to 0.12 wt % of titanium; with the balance being aluminum and impurities, wherein at least 90% of a metallographic structure is a recrystallized structure.

2. The aluminum alloy extrusion material according to claim 1, wherein the aluminum alloy comprises at least one of: 0.05 to 0.08 wt % of zirconium; 0.05 to 0.3 wt % of chromium; 0.05 to 0.2 wt % of manganese; and 0.003 to 0.1 wt % of boron.

3. The aluminum alloy extrusion material according to claim 1, wherein an average crystal particle diameter of the recrystallized structure is no greater than 500 μm.

4. The aluminum alloy extrusion material according to claim 1, wherein the extrusion material has been subjected to a bending process.

5. A manufacturing method of the aluminum alloy extrusion material according to claim 1, comprising:

homogenizing by heating and holding a billet of the aluminum alloy at 450 to 560° C. for 1 to 16 hours and then cooling to an ambient temperature;

obtaining the extrusion material by heating the billet to 400 to 570° C. and extruding at an extrusion rate of 2 to 50 m/min; and aging treating by heating the extrusion material to 110 to 200° C. and holding for 4 to 24 hours.

6. The manufacturing method of the aluminum alloy extrusion material according to claim 5, further comprising performing a bending process on the extrusion material having been subjected to the aging treatment.

7. A manufacturing method of the aluminum alloy extrusion material according to claim 1, comprising:

homogenizing by heating and holding a billet of the aluminum alloy at 450 to 560° C. for 1 to 16 hours and then cooling to an ambient temperature;

obtaining the extrusion material by heating the billet to 400 to 570° C. and extruding at an extrusion rate of 2 to 50 m/min; and aging treating by, in a first stage, performing pre-aging by heating the extrusion material to 90 to 120° C. and holding for 4 to 20 hours, and then, in a second stage, heating to 110 to 200° C., at a higher temperature than a holding temperature in the first stage, to thereby hold for 4 to 24 hours as a total holding time of the first and second stages.

8. The manufacturing method of aluminum alloy extrusion material according to claim 7, further comprising performing a bending process on the extrusion material having been subjected to the aging treatment.

* * * * *